United States Patent [19]

Ohtsuka

[11] 4,367,942

[45] Jan. 11, 1983

[54] XEROGRAPHIC COPYING MACHINE

[75] Inventor: Shuichi Ohtsuka, Asaka, Japan

[73] Assignee: Fuji Photo Film Co., Ltd., Kanagawa, Japan

[21] Appl. No.: 247,491

[22] Filed: Mar. 25, 1981

[30] Foreign Application Priority Data

Mar. 26, 1980 [JP] Japan ..... 55-38407

[51] Int. Cl.[3] ..... G03G 15/00

[52] U.S. Cl. ..... 355/3 R; 355/3 TR; 355/3 BE; 355/8

[58] Field of Search ..... 355/3 R, 3 TE, 3 TR, 355/16, 8, 3 BE

[56] References Cited

U.S. PATENT DOCUMENTS

| | | | |
|---|---|---|---|
| 3,637,303 | 1/1972 | Komori et al. | 355/66 X |
| 3,807,854 | 4/1974 | Tanaka et al. | 355/8 X |
| 3,970,383 | 7/1976 | Honda et al. | 355/8 X |
| 4,076,403 | 2/1978 | Nishikawa et al. | 355/8 X |
| 4,116,557 | 9/1978 | Kushima et al. | 355/8 |

*Primary Examiner*—R. L. Moses

*Attorney, Agent, or Firm*—Sughrue, Mion, Zinn, Macpeak & Seas

[57] ABSTRACT

A xerographic copying machine in which images of easily variable size are copied onto ordinary paper. A stationary optical system projects an optical image onto an image projection surface adjacent which a photosensitive drum is rotatably and linearly movably mounted. The photosensitive drum is rotated at an angular velocity and moved in a linear velocity in a plane parallel to the surface upon which the image is formed at speeds so that the relative linear velocity of a point on the surface of the photosensitive drum and the optical image is substantially zero. An image transferring mechanism confronts a non-image-projection surface of the photosensitive drum for conveying the paper onto which the image is transferred. The linear velocity of the paper as determined by the image transferring medium is such that there is no slippage between the surface of the paper and the photosensitive drum as the drum is moved in a plane parallel to the plane in which the image is formed.

8 Claims, 3 Drawing Figures

XEROGRAPHIC COPYING MACHINE

BACKGROUND OF THE INVENTION

The present invention relates to xerographic copying machines. More particularly, the invention relates to a xerographic copying machine in which an electrostatic latent image or a toner image formed on the surface of an electrophotographic photosensitive element is transferred to an image transfer medium.

In an electrostatic latent image transfer type or toner image transfer type xerographic copying machine called "a PCC (Plain Paper Copier)", in general a photosensitive element in the form of a drum or in the form of an endless belt is employed with exposure of the photosensitive element being carried out by a scanning optical system in which a light beam in the form of a line or a spot is scanned in synchronization with the rotation of the photosensitive element. In a copying machine of this type, the size of the image in the direction of width (or in the axial direction) on the drum or the endless belt is determined from the magnification factor of the image projecting optical system while the size of the image in the direction of rotation of the drum or the endless belt (in a direction perpendicular to the axial direction) is determined from the speed of rotation of the drum or the endless belt or from the speed of movement of the optical image in the axial direction. Accordingly, in order to vary the magnification factor of the image in a xerographic copying machine using the above-described image scanning optical system, it is necessary to move the image scanning optical system or it is necessary to replace the image projecting optical system and to correspondingly change the speed of rotation of the photosensitive element or, if necessary, the speed of movement of the optical image, in synchronization with the operation of the optical system. Accordingly, such a copying machine is disadvantageous in that its mechanism is intricate. Furthermore, as a practical matter, in such a copying machine, the magnification factor can be varied only in two steps. Thus, the use of a xerographic copying machine using the above-described scanning optical system is not suitable for applications where it is necessary to frequently change the copying magnification factor as in a micropicture reader printer, a photographic enlarger and a process camera, or where it is necessary to steplessly change the copying magnification factor as in the case of a zooming operation.

On the other hand, in some electronic photograph copying machines called "CPC's (Coated Paper Copiers)" in which a toner image is formed directly on a xerographic photosensitive sheet such as a ZnO photosensitive sheet, exposure is carried out by a stationary optical system with the xerographic photosensitive sheet fixedly set horizontally in the exposure section in order to simplify the exposure operation as well as to permit variation of the copying magnification factor. In such a copying machine, in order to set the photosensitive sheet at least in the exposure section, it is necessary to intermittently drive the photosensitive sheet and to uniformly hold the photosensitive sheet over the entire exposure surface. Thus, this copying machine is disadvantageous in that it is unavoidably bulky. In addition, such a copying machine is clearly disadvantageous in that images cannot be copied on ordinary paper. In the case where such a technique is utilized for a PPC, the problem that images cannot be copied on ordinary paper may be solved but the other problems still remain.

Accordingly, an object of the invention is to provide a xerographic copying machine in which all of the above-described difficulties accompanying a conventional machine have been eliminated and electrostatic latent images or toner images can be transferred even in applications in which the copying magnification factor is frequently varied.

SUMMARY OF THE INVENTION

In accordance with these and other objects, the invention provides a xerographic copying machine for transferring electrostatic latent images or toner images in which firstly a stationary exposure optical system is employed, secondly a xerographic photosensitive element in the form of a drum or an endless belt is moved along the surface of a projected optical image while being turned in such a manner that the relative linear velocity in a direction parallel to the optical image surface of any point on the surface of the photosensitive element and the projected optical image is substantially zero, and thirdly an image transfer medium is driven in such a manner that the relative linear velocity of the image transfer medium and a point of the surface of the photosensitive element are substantially zero. That is, there is substantially no slippage between the surface of the photosensitive element and either the surface on which the optical image is projected or the surface of the image transfer medium.

More specifically, a xerographic copying machine provided according to the invention includes a stationary exposure optical system for projecting an optical image to be copied, a xerographic photosensitive element in the form of a drum or an endless belt which is subjected to exposure while being turned and moved along the plane onto which the optical image is formed in such a manner that the relative velocity of a point on the surface of the xerographic photosensitive element and the optical image projected by the optical system in a direction parallel to the surface on which the image is projected is substantially zero. To this effect, an image transfer mechanism which confronts the non-image-projection surface of the photosensitive element and which conveys an image transfer medium conveys the image transfer medium at such a velocity that the relative speed of the image transfer medium and a point on the surface of the photosensitive element is substantially zero to thereby transfer an electrostatic latent image or a toner image formed on the surface of the photosensitive element to the image transfer medium without smearing of the image.

DESCRIPTION OF THE PREFERRED EMBODIMENTS

The preferred embodiments of the invention will be described with reference to the accompanying drawings.

Figure 1:
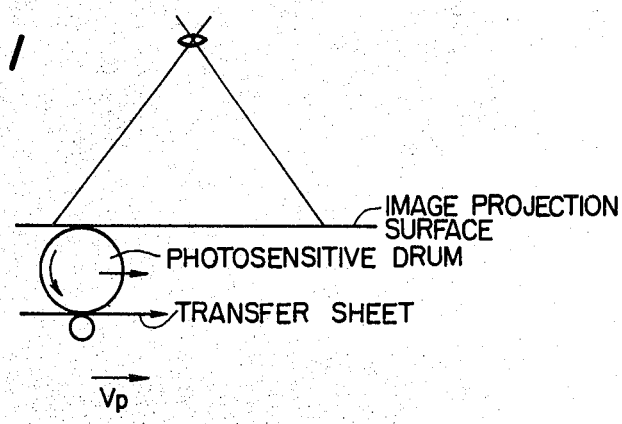
FIG.1 is a longitudinal sectional view for a description of the principles of the invention.

FIG. 1 is a diagram for a description of the principles of operation of a copying machine of the invention. In accordance with the invention, a photosensitive drum is turned counterclockwise and simultaneously moved to the right at rotary and linear speeds $\omega$ and $V_p$, respectively, such that there would be no slippage between the surface of the drum and the optical image projection surface of a stationary exposure system if they were in contact; that is, $\omega \cdot r = V_p$ where r is the radius of the drum and $\omega$ is the angular velocity of the drum. During this operation, the surface of the photosensitive drum is exposed to light through the optical image projection surface as a result of which an electrostatic latent image or a toner image is formed on the surface. On the other hand, a transfer sheet is moved to the right at a speed such that there is no slippage between the transfer sheet and the surface of the photosensitive drum while the static latent image or the toner image is transferred onto the surface of the transfer sheet.

In order to substantially eliminate both slippage between the optical image projection surface and the photosensitive drum surface and slippage between the photosensitive drum surface and the transfer sheet so that there is no distortion of the image, it is necessary that the relative speeds of the optical image projection surface and the photosensitive drum surface and of the photosensitive drum surface and the transferring sheet be not more than 10% of the linear speed $V_p$ of the center of the photosensitive drum, preferably not more than 2%.

The xerographic copying machine of the invention according to the above-described principle has the following advantages:

(1) As the optical system is completely stationary, a satisfactory copying operation in which the driving of the photosensitive drum or the endless belt is not employed is provided irrespective of the variations in the magnification of the optical system.

(2) As a stationary optical system is employed, it is unnecessary to use a method of positioning the lenses, mirrors, etc. with an extremely high accuracy even in the case where the lens has a high magnification factor.

(3) The horizontal speed of any point on the surface of the photosensitive element (drum) relative to the optical image surface is substantially zero. Therefore, even if the exposure slit width is made large and the exposure time is set sufficiently long, the resolution of the image is not lowered. Accordingly, even if a photosensitive material having a low sensitivity is used, a satisfactory image is obtained without decreasing the processing speed. In accordance with the invention, if the relative speed of the photosensitive element surface and the projected optical image is represented by $\Delta V$, the movement speed of the center of the photosensitive by $V_p$, the slit width by l, the drum's radius by r, and the angular velocity of the rotating drum by $\omega$, then the exposure time T and the magnitude d of out-of-focus of the image can be expressed by the following equations:

$$T = l/\omega \cdot r,$$

$$d = T \cdot \Delta V = l \cdot \Delta V / V_p, \text{ and}$$

$$\Delta V = V_p - \omega \cdot r.$$

For instance, in the case where $\Delta V/V_p$ is set to 1% or less, even with the slit width l being 10 mm, d=0.1 mm can be obtained. Thus, a practical and satisfactory image is obtained.

(4) In the image transferring section, the relative horizontal speed of a point of the number of the photosensitive system and the transfer medium is substantially zero. Therefore, the image is transferred without fluctuation or distortion.

(5) A more specific feature of the invention is that, although the width (in the axial direction) of the photosensitive drum or the endless belt should be larger than the size of an image to be copied, it is not always necessary that the dimension thereof in the direction perpendicular to the width (i.e. the circumference of the drum or the length of the belt) be larger than the size of the image. Accordingly, the drum or the endless belt employed in the invention can have a small diameter and be lightweight. This effect should be highly appreciated because the drum or the endless belt runs along the image projection surface.

The electronic photograph copying machine according to the invention is applicable to a toner image which is obtained according to xerographic techniques or to an electrostatic image which is obtained according to a successive electrostatic image transferring method, hereinafter referred to merely as "a successive TESI (Transfer of Electrostatic Image) method", when applicable.

In the case where the copying machine according to the invention is applied to a toner image which is obtained according to a xerographic technique, the photosensitive element employed usually in the xerography is used in the form of a drum or in the form of a belt which is run endlessly. It goes without saying that other devices such as a charging device, a developing device and a photosensitive element cleaning device which are commonly used in xerography are provided at suitable positions in the photographic system of the copying machine of the invention. Furthermore, it is necessary to provide devices required for transferring toner images in the image transferring section.

In the case where the invention is applied to the successive TESI method, a photosensitive element necessarily employed with the successive TESI method can be used with the invention.

The term "successive TESI method" as used herein is intended to mean a method, as disclosed by the specifications of U.S. Pat. Nos. 2,833,268, 2,937,943, 2,982,647 and 3,055,006, in which, after an electrostatic latent image is formed on a xerographic photosensitive element according to an ordinary method, the image is transferred onto to a transfer medium.

In the case where the successive TESI method is employed for the copying machine of the invention, devices required for practicing the successive TESI method such as a charging device, a developing device for developing a transferred latent image, and a device for eliminating or erasing image remnants on the photosensitive element can be used as the case may be.

An electronic photograph copying machine of the invention will be described with reference to FIG. 2 in more detail, in which by way of example, the invention is applied to the successive TESI method. An optical image is formed on a surface 2-2 by means of a lens 2-1 in a stationary optical system. The size of the optical image can be controlled by changing the lens. A photosensitive drum 2-0 is disposed immediately below a slit 2-11 which is flush with the surface 2-2 and an opticalimage is formed on the drum 2-0 through the slit 2-11. In this connection, it should be noted that the photosensitive drum 2-0 has been uniformly charged by a corona charger 2-3 before reaching the exposure region.

With this structure, an electrostatic latent image is formed according to the amount of exposure of the photosensitive drum thus exposed. The latent image is then transferred onto an electrostatic recording sheet 2-7 which is inserted between the drum and an electrostatic latent image transfer roll 2-4. The electrostatic latent image thus transferred is developed on the electrostatic recording sheet in a developing and fixing section 2-9. In order to remove image remnants from the photosensitive drum after the latent image has been transferred, the drum is subjected to uniform light irradiation by a light source 2-12. The photosensitive drum is displaced while being turned with the center of the drum moved at a speed $V_p$ while the speed of the exposure portion (or the upper end) of the drum is zero and the speed of the transfer portion (or the lower end) of the drum is $2V_p$. The exposure slit 2-11, the charger 2-3, the light source and the image transfer roll 2-4 are moved at the same speed as the center of the drum; that is, the relative position of these components is maintained unchanged during the described movement. The electrostatic recording sheet 2-7 passes through the image transferring section at the speed $2V_p$ then it moves to the developing section 2-9. In order to convey the electrostatic recording sheet 2-7, two conveying belts 2-6 are provided the first ends of which are fixedly secured to the image transferring roll 2-4 and the other ends to winding buffers 2-5. In order that the conveying belts be maintained under tension during the movement of the photosensitive drum 2-0, one conveying belt is allowed to go in the respective winding buffer 2-5 while the other conveying belt is allowed to go out of the respective winding buffer 2-5 keeping step with the displacement of the photosensitive drum. The electrostatic recording sheet 2-7 loaded in the copying machine of the invention may be in the form of a sheet or roll as desired. In the latter case, it is necessary to provide a cutter 2-8 for cutting the recording sheet. In the case of FIG. 2, the photosensitive drum 2-0 is displaced at the speed $V_p$ from the left to the right while being rotated at an angular speed $\omega$ during which the exposure and the transfer of the latent image are carried out. These operations are completed when the drum reaches the right end in FIG. 2. In this connection, control is so made that, when the aforementioned operations are achieved, the rear end of the electrostatic recording sheet at which the recording sheet is cut to the length L of the moving exposure section of the photosensitive drum passes through the transfer portion (the lower end) of the drum. After the recording has been completed, the photosensitive drum is moved to the left in the view of FIG. 2 for the next recording operation to a position so as to clamp the front end of a new electrostatic recording sheet with the transfer portion of the drum.

The difference between $\omega \cdot r$ and $V_p$ is set to be not more than 1% of $V_p$. Therefore, even if the slit width (2-11) above the exposure portion of the drum is 10 mm, satisfactory images are reproduced. The image transferring roll 2-4 is so designed that it follows the operation of the photosensitive drum. Therefore, the speed of movement of the electrostatic recording sheet is substantially equal to the speed of movement of the transfer portion of the photosensitive drum as a result of which the electrostatic latent image is transferred without smearing.

Figure 2:
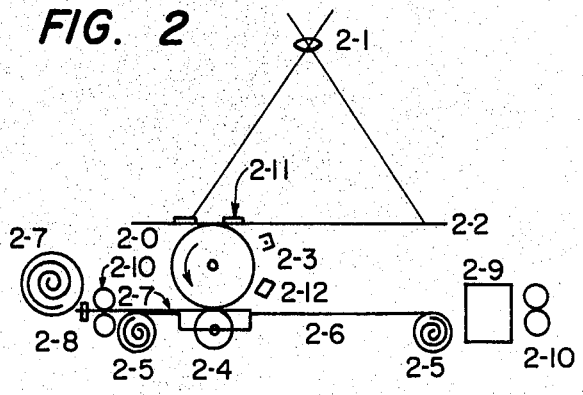
FIGS. 2 and 3 are longitudinal sectional view showing first and second embodiments, respectively, of a xerographic copying machine constructed according to the invention.
Figure 3:
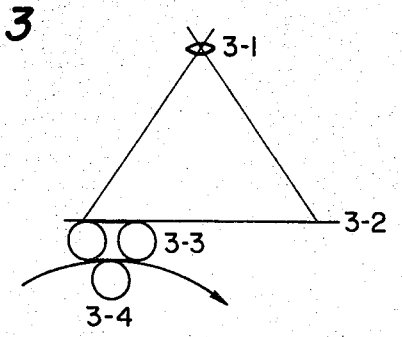

In the copying machine shown in FIG. 2, only one photosensitive drum is employed; however, the invention is not limited thereto or thereby. That is, instead of the photosensitive drum, a photosensitive endless belt 3-3 laid over two rolls may be employed as shown in FIG. 3.

What is claimed is:

1. A xerographic copying machine comprising:

a stationary exposure optical system for projecting an optical image to be copied;

a xerographic photosensitive element having a photosensitive surface;

means for moving said photosensitive element in a plane parallel to a plane in which said optical image is formed while simultaneously moving said photosensitive surface of said element in such a manner that the relative linear velocity of a point on said surface of said photosensitive element and said optical image projected by said optical system in a plane parallel to said plane in which said image is formed is substantially zero; and an image transferring mechanism confronting said surface of said photosensitive element for conveying an image transfer medium in such a manner that the relative linear velocity of said image transfer medium and a point on said surface of said photosensitive element in a plane parallel to said plane in which said image is formed is substantially zero to transfer an image formed on said surface of said photosensitive element to said image transfer medium, said photosensitive element comprises an endless belt having a photosensitive surface.

2. The copying machine of claim 1 further comprising an image projection surface disposed between said stationary exposure optical system and said xerographic photosensitive element, said stationary exposure optical system projecting said optical image onto said image projection surface.

3. The copying machine of claim 1 wherein said relative linear velocity of a point on said photosensitive surface of said photosensitive element and said optical image projected by said optical system and said relative linear velocity of said image transferring medium and a point on said photosensitive surface of said photosensitive element differ from the speed at which said photosensitive element is conveyed in a direction parallel to said plane in which said optical image is formed by no more than 10%.

4. The copying machine of claim 1 wherein said relative linear velocity of a point on the surface of said photosensitive element and said optical image projected by said optical system and said relative linear velocity of said image transferring medium and a point on the surface of said photosensitive element differ from the speed at which said photosensitive element is conveyed in a direction parallel to said plane in which said optical image is formed by no more than 2.

5. The copying machine of claim 1 wherein said image formed on said photosensitive surface of said photosensitive element is an electrostatic latent image.

6. The copying machine of claim 1 wherein said image formed on photosensitive surface of said photosensitive element is a toner image.

7. The copying machine of claim 1 wherein said optical system comprises a continuously adjustable lens for producing an image of a predetermined variable size.

8. The copying machine of any one of claims 1–7 further comprising slit means disposed adjacent said image transferring mechanism through which an optical image is formed on said photosensitive element; a corona charger disposed to uniformly charge said photosensitive element before said photosensitive element reaches an exposure region; and electrostatic latent image transfer roll disposed parallel to and adjacent said photosensitive element, an electrostatic recording sheet being insertable between said photosensitive element and said electrostatic latent image transfer roll; and a developing and fixing section for developing an image transferred to said electrostatic recording sheet.

* * * * *